United States Patent [19]

Sailer

[11] Patent Number: 4,734,016

[45] Date of Patent: Mar. 29, 1988

[54] PLUG-IN TYPE PUMP ASSEMBLY

[75] Inventor: Thomas Sailer, Amherst, Ohio

[73] Assignee: Lear Siegler, Inc., Elyria, Ohio

[21] Appl. No.: 929,770

[22] Filed: Nov. 13, 1986

[51] Int. Cl.[4] ..... F04B 35/00

[52] U.S. Cl. ..... 417/360; 417/423 R; 137/590

[58] Field of Search ..... 417/234, 360, 423 T; 222/333, 385; 123/509; 137/565, 585, 590

[56] References Cited

U.S. PATENT DOCUMENTS

| | | | |
|---|---|---|---|
| 2,940,643 | 6/1960 | Olson | 222/385 X |
| 2,978,150 | 4/1964 | Doelcher | 222/333 |
| 3,000,543 | 9/1961 | Paul | 222/333 |
| 3,143,971 | 8/1964 | Green | 417/360 |
| 3,172,365 | 3/1965 | Nasvytis | 417/360 |
| 3,679,092 | 7/1972 | Sullivan | 137/590 |
| 4,324,532 | 4/1982 | Knife | 417/360 |
| 4,403,923 | 9/1983 | Korchin | 417/360 |
| 4,661,046 | 4/1987 | Ruyle | 415/72 X |

FOREIGN PATENT DOCUMENTS

| | | | |
|---|---|---|---|
| 59-087264 | 5/1984 | Japan | 123/509 |

*Primary Examiner*—Carlton R. Croyle
*Assistant Examiner*—Eugene L. Szczecina, Jr.
*Attorney, Agent, or Firm*—Renner, Otto, Boisselle & Lyon

[57] ABSTRACT

Pump assembly includes a rotatable handle with integral cams thereon to releasably retain the pump assembly within a receiver. During assembly, the pump assembly is initially inserted only part way into the receiver to a first intermediate non-operating position and then rotated a part turn to cause the cams on the handle to be engaged inside receiver lugs on the receiver housing which retain the pump assembly in a second intermediate non-operating position for pump drainage. While in such second intermediate non-operating position, the handle may be rotated between closed and open positions to respectively push the pump assembly further into the receiver to an operating position and pull the pump assembly back out to the second intermediate non-operating position. Seal means between the pump assembly and receiver are respectively engaged and disengaged during camming movement of the pump assembly between such operating and non-operating positions. Also, one or more valve means are respectively opened and closed during each camming movement of the pump assembly between such operating and non-operating positions. The handle may be trapped in the closed position by an electrical connector which is adapted to be connected to the outer end of the pump assembly to provide power to operate the pump assembly. A cover plate may be used to cover an access opening to the pump assembly when the pump assembly is in the operating position within the receiver. The handle assembly will permit attachment of the cover plate to the access opening only when the pump assembly is in the operating position and the handle is in the closed position.

29 Claims, 15 Drawing Figures

PLUG-IN TYPE PUMP ASSEMBLY

BACKGROUND OF THE INVENTION

The present invention relates generally, as indicated, to a pump assembly of the plug-in type, and more particularly, to certain improvements in such a pump assembly which greatly facilitate the installation, retention and service removal of such pump assembly from a receiver within a tank such as an aircraft fuel tank from which fuel or other fluid is to be pumped by such pump assembly.

In certain pump installations such as those utilizing booster pumps to transfer fluids such as fuel from an aircraft fuel tank to an engine fuel pump or to the aircraft engine itself, it is desirable to be able to easily install and remove such pumps for servicing and/or overhaul or replacement. Conventional practice has included the provision of a receiver within the tank for receipt of a plug-in type pump assembly. In the usual case, the pump assembly is retained within the receiver by means of bolts or screws which require the use of tools for installation and removal. Also, such screws require threaded inserts within the receiver which are susceptible to damage and are expensive to replace and/or repair.

Other plug-in type pump assembly designs utilize ramps in the receiver which pull the pump assembly into position when the pump assembly is rotated during installation. However, these installations also require special installation tools and the like.

SUMMARY OF THE INVENTION

With the foregoing in mind, it is a principal object of this invention to provide a plug-in type pump assembly which does not require the use of any tools to install or remove the pump assembly from a receiver.

Another object is to provide such a pump assembly which substantially reduces the time required to install and/or remove the pump assembly from a receiver.

A further object is to provide a receiver for such pump assembly that does not contain any parts that are susceptible to damage during pump installation or removal.

Still another object is to provide such a pump assembly which can initially be inserted into the receiver in only one orientation.

Another object is to provide such a pump assembly in which mechanical leverage is used to move the pump assembly between an intermediate non-operating position inserted part way into the receiver with minimum sealing therebetween and an operating position fully inserted into the receiver, with maximum sealing therebetween.

Yet another object is to provide such a pump assembly in which an axial pushing and pulling force is applied to the pump assembly to respectively move the pump assembly into and out of the operating position.

Still another object is to provide such a pump assembly in which a reaction force is applied to the pump assembly when in such operating position to compensate for any tolerances in the receiver and pump assembly.

A further object is to provide such a pump assembly which cannot be installed past the operating position.

Yet another object is to provide such a pump assembly which respectively opens and closes one or more valves in the receiver during axial movement of the pump assembly into and out of the operating position.

Another object is to provide such a pump assembly which is locked against movement when in the operating position.

A further object is to provide such a pump assembly which may be releasably held in the receiver when in an intermediate drain position to prevent the pump assembly from inadvertently falling out or being pulled out of the receiver during draining of the pump assembly.

Another object is to provide such a pump assembly with minimum sealing contact between the pump assembly and receiver during rotation of the pump assembly between a first non-operating position within the receiver and a second non-operating drain position.

Still another object is to provide such a pump assembly in which the pump axis is inclined from the vertical within a fluid tank to improve pump inlet fluid flow conditions and minimize pump height.

In accordance with one aspect of the invention, the pump assembly includes a pivotal handle with cams thereon which cooperate with receiver lugs on the receiver housing to releasably retain the pump assembly within the receiver. During assembly, the pump assembly is initially inserted axially part way into the receiver to a first intermediate non-operating position and then rotated a part turn to cause the cams to be received inside the receiver lugs which retain the pump assembly in a second intermediate non-operating position for pump draining. Thereafter, upon pivoting of the handle to a handle locked position, the cams in cooperation with the receiver lugs will push the pump assembly axially into the receiver to an operating position.

In accordance with another aspect of the invention, upon pivoting of the handle from the locked position to an unlocked position, the cams will pull the pump assembly axially part way out of the receiver to the second intermediate non-operating pump drain position.

Further in accordance with the invention, the pump assembly is movable axially into and out of sealing engagement with the receiver during pivoting of the handle between the handle locked and unlocked positions.

Also in accordance with the invention, when the pump handle is in the locked position, one or more valves are opened, whereas when the pump handle is in the unlocked position, such valves are closed.

In accordance with still another aspect of the invention, after the pump housing has been initially inserted in the receiver and rotated so the handle cams are received within the receiver lugs, the pump assembly cannot fall out or be pulled out of the receiver.

Further in accordance with the invention, when the pump handle is in the unlocked position, all but one of the seals on the outside of the pump assembly are disengaged from the receiver bore to minimize the force necessary to turn the pump assembly in the receiver.

Also in accordance with the invention, the majority of the seals are desirably engaged during pump installation and disengaged during pump removal only when the highly leveraged force from the pump handle cams is active to respectively push and pull the pump assembly into and out of the receiver.

In accordance with another aspect of the invention, the cams on the pump handle move to an over-center position when the handle is in the locked position, whereby any forces tending to push the pump assembly out of the receiver during operation of the pump will urge the handle toward the locked position.

Still further in accordance with the invention, the final travel of the pump assembly in the receiver to the operating position contacts a main shut-off valve in the receiver to deflect the main shut-off valve to the open position.

In accordance with yet another respect of the invention, the main shut-off valve is carried by a valve spring arm which is deflected during the final travel of the pump assembly to the operating position to ensure that the main shut-off valve is securely loaded in the open position when the pump assembly is in the operating position. The deflection of the valve spring arm produces a reaction force which is transmitted through the pump assembly to the cams on the pump handle and into the receiver lugs to compensate for any tolerances in the receiver and pump assembly when the pump assembly is in the operating position.

In accordance with a further aspect of the invention, when the pump handle is in the unlocked position with the cams received within the receiver lugs, the pump housing may, if desired, be drained of any trapped fluids by removing a drain plug from the axial outer end of the pump housing.

Still further in accordance with the invention, the pump handle may be retained in the locked position by a removable plug-in electrical connector.

To the accomplishment of the foregoing and related ends, the invention, then, comprises the features hereinafter fully described and particularly pointed out in the claims, the following description and accompanying drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
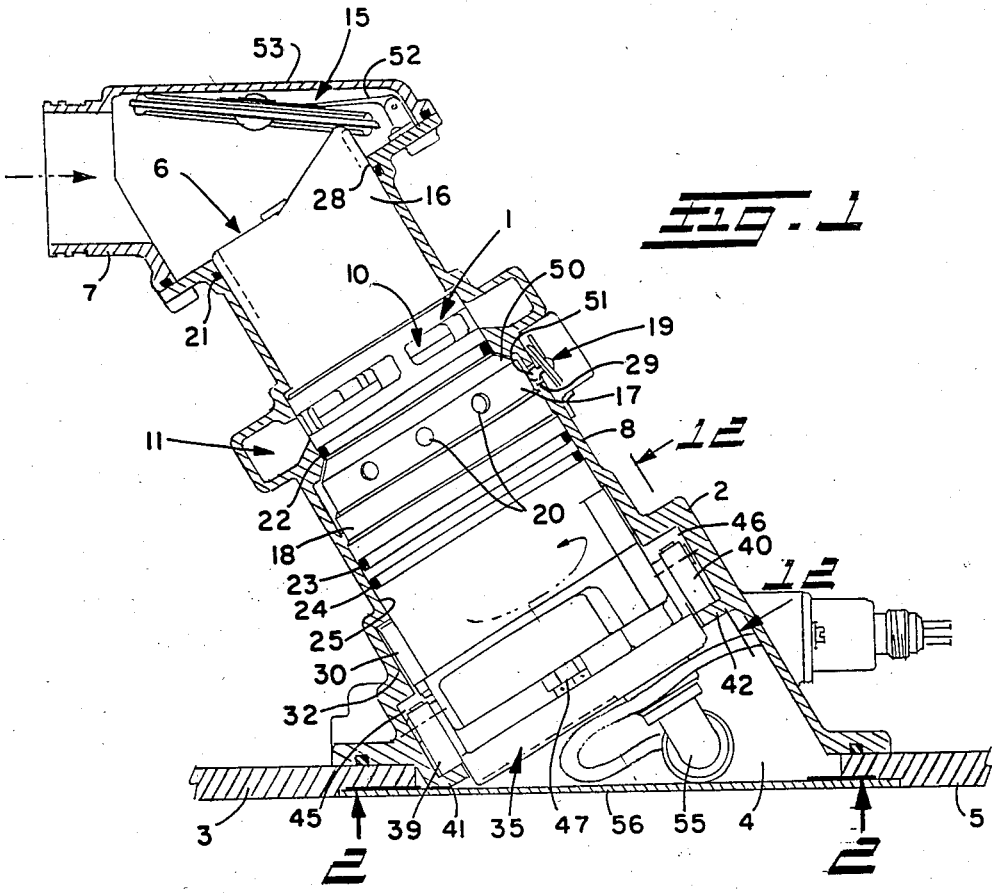
FIG. 1 is a side elevation view of a preferred form of pump assembly in accordance with this invention shown in an operating position within a receiver in a fluid tank, the receiver being shown in section.

Referring now in detail to the drawings, and initially to FIG. 1, there is shown a referred form of pump assembly 1 in accordance with this invention received within a receiver 2 within a fluid tank 3. The particular pump assembly disclosed herein is an electric motor driven fuel boost pump of the type used to pump aircraft fuel from tank 3 of the aircraft to the aircraft engines. The receiver 2 is permanently mounted within the fuel tank and is accessible from outside the tank through an access opening 4, for example, in the aircraft wing 5. The receiver is desirably inclined at an angle relative to the vertical within the fuel tank 3 as shown, whereby when the pump assembly is properly installed within the receiver, the pump assembly will also be disposed at an angle relative to the vertical to improve pump inlet fuel flow conditions and minimize pump height.

During operation, the pump assembly 1 draws fuel into a pump inlet 5 at the upper (inner) end thereof through an inlet line 7 connected to the receiver housing 8 and discharges same under pressure through a pump outlet 10 into a pump discharge volute 11 in the receiver surrounding the pump outlet. The pump discharge volute 11 is in turn suitably connected to the aircraft plumbing (not shown) for directing the fuel to the aircraft engines.

As described in greater detail hereafter, the pump assembly 1 is of an improved plug-in design which provides for the simple installation and retention of the pump assembly in the receiver as well as the easy removal therefrom by hand without the need for any tools or the like.

When the pump assembly 1 is installed in the operating position within the receiver 2 a shown in FIG. 1, a service or main inlet shut-off valve 15 at the axial inner end of the receiver is held open by engagement by a shroud 16 which surrounds the inlet 6 to the pump. Also, an external shoulder 17 on the pump housing or cartridge 18 maintains a small vapor vent service valve 19 in the receiver 2 in the open position shown in FIG. 1 for venting fuel vapors from within the pump assembly 1 through radial vent passages 20 in the pump housing. Suitable seals 21–24 are provided between the external stepped surface of the pump housing 18 and internal stepped bore 25 in the receiver 2 on opposite sides of the pump outlet 10 and radial vent passages 20 to isolate same.

Figure 4A:
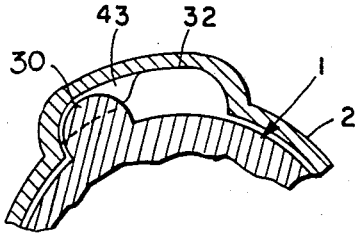
FIG. 4A is an enlarged fragmentary transverse section through the pump assembly and receiver of FIG. 1 to show an orientation lug on the pump housing that is received in an orientation slot in the receiver.
Figure 4:
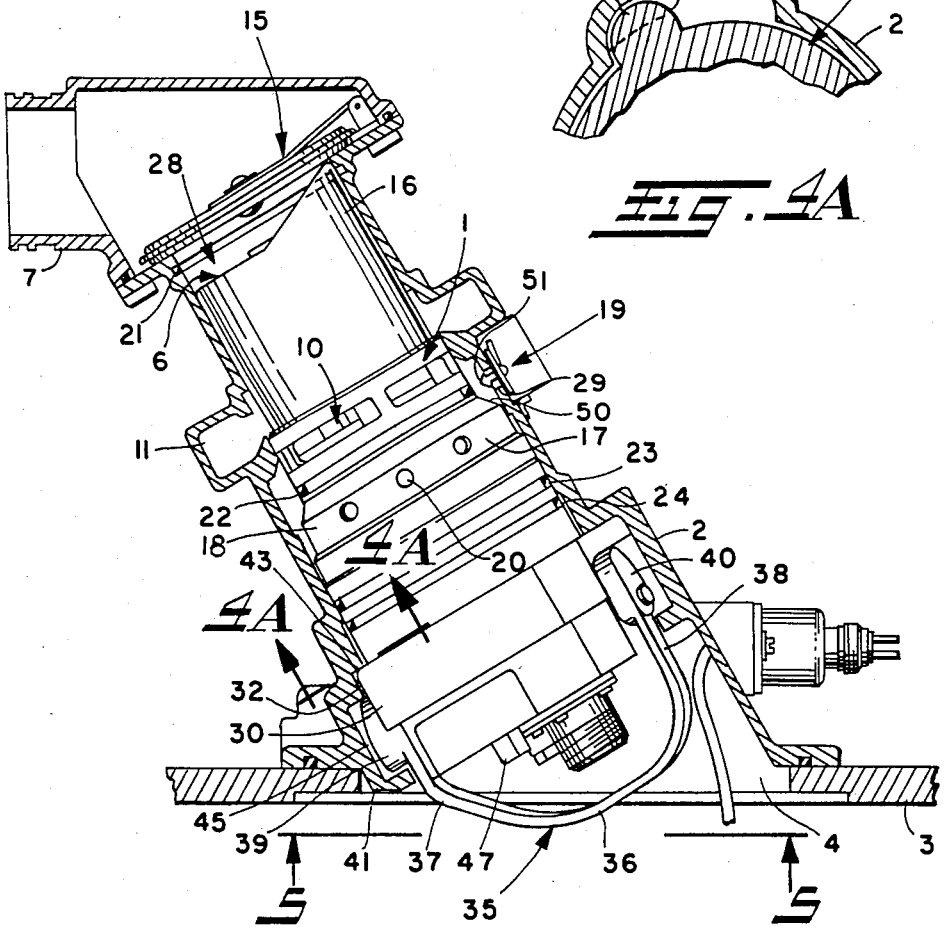
FIG. 4 is a side elevation view of the pump assembly similar to FIG. 1, but showing the pump assembly inserted part way into the receiver to a first intermediate, non-operating position within the receiver, shown in section.

During installation of the pump assembly 1 in the receiver 2, the pump assembly is initially inserted only part way into the receiver to an intermediate non-operating position in which the shroud 16 at the inlet end of the pump housing 18 and external shoulder 17 on the pump housing have not yet engaged the respective main inlet shut-off valve 15 and vapor vent service valve 19, whereby such valves still remain closed as shown in FIG. 4. Also, all but one of the seals 21–24 are disengaged when the pump assembly is in the intermediate non-operating position shown in FIG. 4 (the seal 23 being the only one engaged) for a purpose to be subsequently described.

When the main inlet shut-off valve 15 is closed as shown in Fig. 4, such valve overlaps and seals the inlet opening 28 at the inner end of the receiver, thus preventing fuel or other fluid from entering the main body portion of the receiver through the inlet line 7. Likewise, when the vapor vent service valve 19 is closed, fuel or other fluid is prevented from entering the receiver through the vent opening 29 in the side of the receiver 2.

During such initial insertion of the pump assembly into the receiver, the pump assembly can only be inserted into the receiver in one rotational orientation because of orientation lugs 30 on the exterior of the pump housing 18 that are received in orientation slots 32 in the receiver housing 8. In the preferred form of the invention disclosed herein, two such orientation lugs 30 and associated receiver slots 32 are provided on opposite sides of the assembly.

Figure 5:
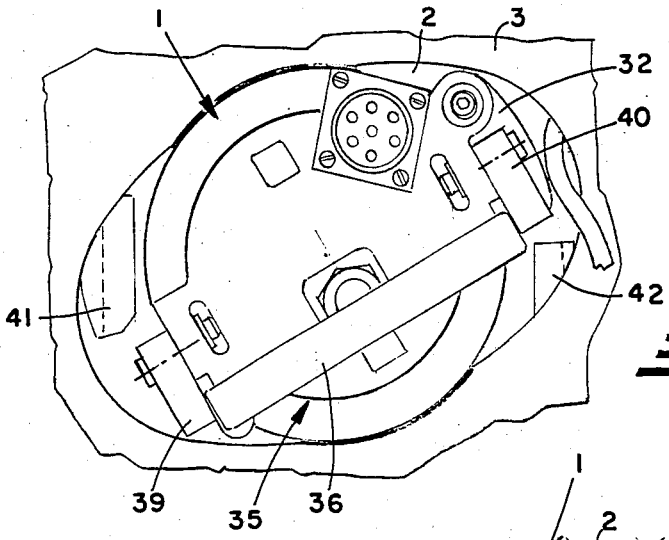
FIG. 5 is a partial bottom plan view of the pump assembly and receiver of FIG. 4 as seen from the plane of the line 5—5 thereof.

Also a pivotal handle assembly 35 is provided on the outer end of the pump housing 18 to facilitate insertion and removal of the pump assembly from the receiver. As clearly shown in FIGS. 4–7, the handle assembly includes an outer handle portion 36 having arms 37, 38 at opposite ends thereof, with integral cams 39, 40 on the inner ends of the arms which must also be oriented out of axial alignment with receiver lugs 41, 42 on opposite sides of the receiver in order to initially insert the pump assembly into the receiver. The arms 37, 38 are suitably pivotally connected to opposite sides of the pump assembly to permit pivoting of the handle assembly and integral cams between an unlocked position in which the handle extends downwardly from the pump assembly as shown in FIGS. 4–6 and a locked position in which the handle lies up against the bottom end of the pump assembly as shown in FIGS. 1 and 2.

Prior to insertion of the pump assembly into the receiver, the handle assembly 35 should be in the down, unlocked position to facilitate grasping of the handle portion 36 by the operator and insertion of the pump assembly into the receiver to the intermediate non-operating position previously described. Stop shoulders or ledges 43 extending part way into the respective slots 32 intermediate the length thereof act as stops limiting the initial inward movement of the pump assembly into the receiver upon engagement of the pump orientation lugs 30 with the shoulders to properly locate the handle cams 39, 40 in the same transverse plane in radial alignment with cam receiving slots 45, 46 in the respective lugs 41, 42. Then, with the handle still in the down, unlocked position, the pump assembly is free to be rotated counterclockwise a part turn from the first intermediate position shown in FIG. 4 to a second intermediate position shown in FIGS. 6 and 7 in which the cams 39, 40 on the handle assembly 35 are received within the slots 45, 46 in the receiver lugs 41, 42 on opposite sides of the receiver so that the pump assembly cannot fall out or be pulled out of the receiver while in this position. Moreover, the configuration of the cams 39, 40 on the handle assembly and slots 45, 46 in the receiver lugs 41, 42 are preferably such that as long as the handle assembly is in the down, unlocked position, the pump assembly is free to be rotated between such first and second intermediate positions with all but one of the seals 21–24 on the outside of the pump assembly disengaged from the receiver housing 8 and pump shroud 16 to minimize the force necessary to turn the pump assembly in the receiver.

Figure 6:
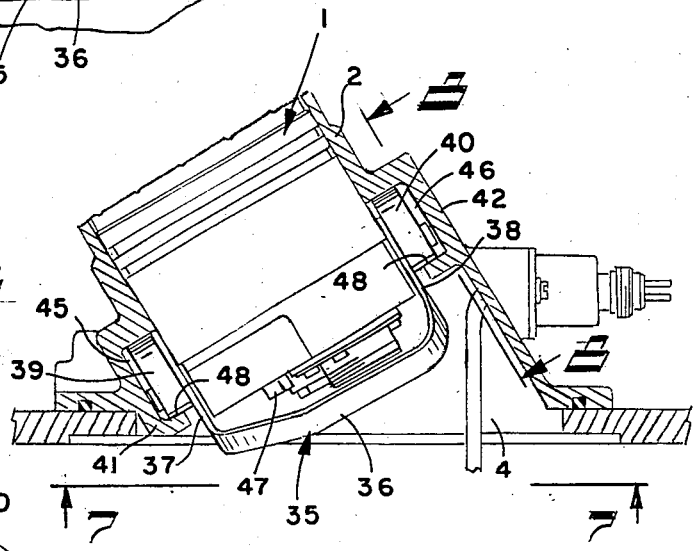
FIG. 6 is a fragmentary side elevation view of the outer end of the pump assembly, similar to FIG. 4, but showing the pump assembly rotated to a second intermediate, non-operating position in which cams on the pump handle are received in lugs in the receiver to prevent the pump from falling out of the receiver.
Figure 6A:
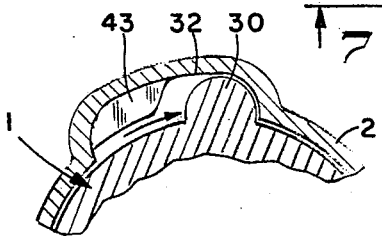
FIG. 6A is an enlarged fragmentary transverse section through the receiver and pump assembly similar to FIG. 4A but showing the position of the orientation lug on the pump housing within the orientation slot in the receiver when the pump assembly has been rotated in the FIG. 6 position.
Figure 7:
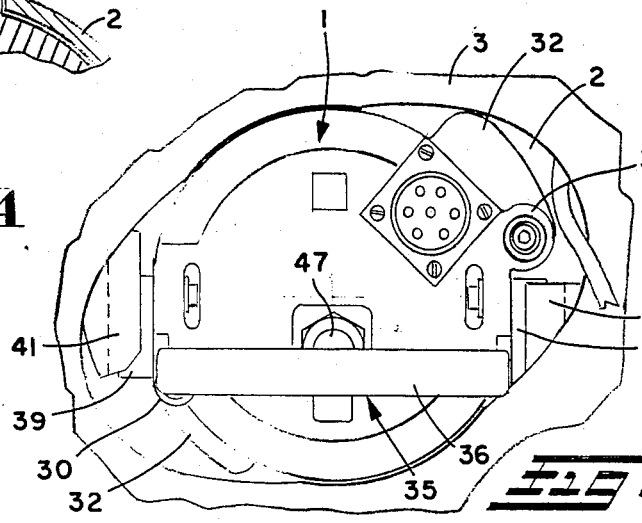
FIG. 7 is a partial bottom plan view of the pump assembly and receiver of FIG. 6 as seen from the plane of the line 7—7 thereof.

The second intermediate position of the pump assembly shown in FIGS. 6 and 7 with the handle down in the unlocked position is the pump drain position in which the pump housing 18 can be drained of any trapped fuel or other fluid by removing a drain plug 47 from the outer end of the pump housing while the pump assembly is still fully supported within the receiver by engagement of the cams 39, 40 in the receiver lugs 41, 42 and the valves 15, 19 are closed. Also, when the pump assembly is in the second intermediate position, the orientation lugs 30 on the pump housing 18 clear the stop shoulders 43 within the receiver slots 32 so that the pump assembly is free to be moved into the receiver to the operating position shown in FIG. 1 as described hereafter.

Figure 2:
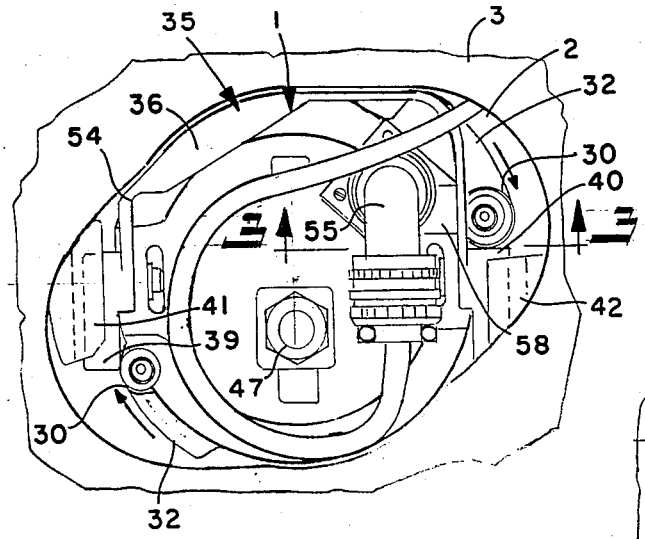
FIG. 2 is a partial bottom plan view of the pump assembly and receiver of FIG. 1 as seen from the plane of the line 2—2 thereof.
Figure 8:
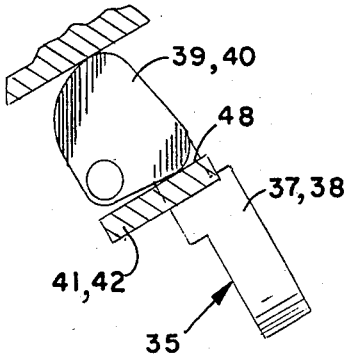
FIG. 8 is an enlarged fragmentary side elevation view of the pump handle of FIG. 6 in the unlocked position, as seen from the plane of the line 8—8 thereof.
Figure 9:
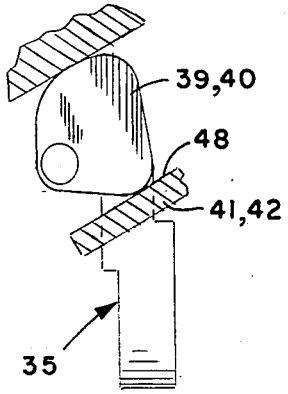
FIGS. 9–11 are enlarged fragmentary side elevation views of the pump handle, similar to FIG. 8, but showing the pump handle being progressively pivoted toward the fully locked position.
Figure 10:
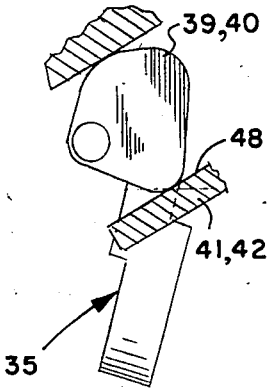
Figure 11:
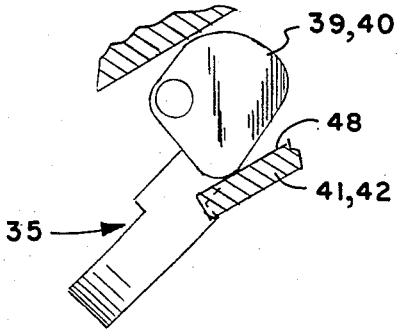
Figure 12:
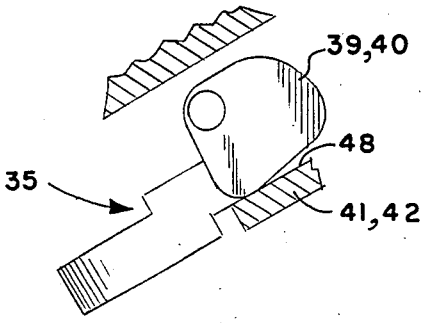
FIG. 12 is an enlarged fragmentary side elevation view of the pump handle of FIG. 1 in the locked position, as seen from the plane of the line 12—12 thereof.

Movement of the pump assembly from the pump drain position shown in FIGS. 6 and 7 to the operating position shown in FIGS. 1 and 2 is accomplished by pivoting the handle assembly 35 from the down, unlocked position (FIGS. 6–8) to the up, locked position (FIGS. 1, 2 and 12). As the handle assembly is pivoted through the intermediate positions shown in FIGS. 9–11, the pump assembly is pushed up into the receiver by the mechanical leverage of the cams 39, 40 acting against the inwardly facing surfaces 48 of the receiver lugs 41, 42. During such axial inward movement of the pump assembly, the leveraged force from the handle assembly and cams is used to force the other seals 22 and 24 on the outside of the pump housing 18 into engagement with the stepped receiver bore 25 and the seal 21 within the receiver bore 25 into sealing engagement with the pump shroud 16.

Also during such axial inward movement of the pump assembly, the pump shroud 16 at the inner end of the pump assembly moves the service shut-off valve 15 to the open position, and an inclined ramp 50 on the pump housing engages a cone-shaped pin 51 in the center of the vapor vent service valve 19 pushing the pin back to open the valve 19.

The service shut-off valve 15 is desirably biased into engagement with the open inner end 28 of the receiver 2 by a spring arm 52 supported by an inlet valve pump housing casting 53. Before the pump assembly reaches the final desired operating position within the receiver shown in FIG. 1, the service shut-off valve 15 desirably bottoms on the top of the inlet valve housing casting so that the final travel of the pump assembly into the receiver deflects the valve spring arm 52 slightly to ensure that the service shut-off valve is loaded securely in the open position. Such loading of the valve spring arm 52 creates a reaction force which is transmitted through the pump housing 18 to the cams 39, 40 on the pump handle assembly 35 and into the receiver lugs 41, 42, which is sufficient to compensate for any tolerances in the receiver and pump assembly when the pump assembly is in the operating position shown in FIGS. 1 and 2.

The pump assembly cannot be inserted past the operating position because of the stepped configuration of the receiver and pump housing which limits axial inward movement of the pump assembly within the receiver housing. When the pump assembly is in the operating position with the handle 35 in the fully locked position shown in FIGS. 1 and 2, the pump handle cams 39, 40 are desirably in an over-center position (see FIG. 12), whereby any forces acting on the pump assembly tending to push the pump assembly out of the receiver will urge the handle assembly tighter up against the bottom of the pump assembly to retain the pump assembly in the operating position. Moreover, counterclockwise rotation of the pump assembly to a position in which the cams 39, 40 are no longer trapped by the receiver lugs 41, 42 is precluded when the pump assembly is in the operating position and the handle assembly is in the closed, locked position by a portion 54 of the handle which extends radially outwardly of one of the receiver lugs 41 in close proximity thereto (see FIG. 2).

Figure 3A:
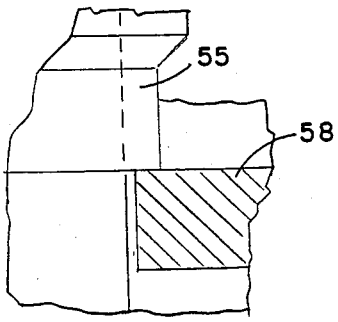
FIG. 3A is a further enlargement of a portion of the electrical connector which overlies a locking tab on the pump handle.
Figure 3:
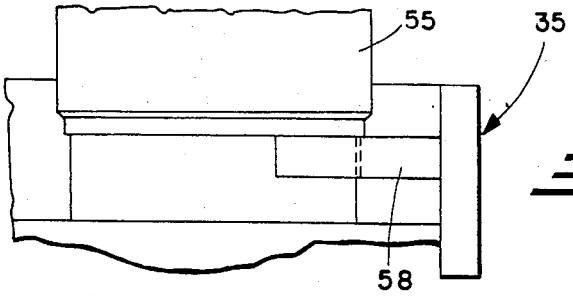
FIG. 3 is an enlarged fragmentary longitudinal section through the lower end of the pump assembly of FIG. 1 showing how the electrical connector is used to trap the pump handle in the locked position.

To complete the assembly, an electrical connector 55 is connected to the outer end of the pump assembly to provide power to operate the same, following which a wing access cover plate 56 is inserted in place to close the access opening 4 in the wing 5 (see FIG. 1). Preferably, the shape of the electrical connector 55 and handle assembly 35 are such that the handle assembly will interfere with the attachment of the electrical connector to the pump assembly except when the handle assembly is in the closed, locked position. Moreover, the handle assembly and electrical connector will interfere with the attachment of the wing access cover plate 56 to the wing if the pump handle is not in the full locked position and the electrical connector is not attached to the pump assembly. When the handle is in the locked position and the electrical connector is connected to the pump assembly, the electrical connector desirably traps the handle in the locked position by overlapping a handle locking tab 58 on the handle assembly as shown in FIGS. 2, 3 and 3A.

To remove the pump assembly from the receiver housing, the installation procedure is reversed. That is, first the wing access cover plate 56 is removed, followed by removal of the electrical connector 55. Then the pump handle 35 is pivoted downwardly from the locked position to the unlocked position, during which the mechanical advantage of the cams 39, 40 is made use of once again, this time to pull the pump assembly part way out of the receiver housing until the service shut-off valve 15 and vapor vent service valve 19 close and all but one of the seals 22–24 on the outside of the pump assembly become disengaged within the receiver bore due to the stepped configuration of the receiver bore and pump housing and the seal 21 becomes disengaged from the pump shroud 16. With the handle in such unlocked position, it is a simple matter to fully remove the pump assembly simply by rotating the pump assembly counterclockwise a part turn from the FIG. 7 position to the FIG. 5 position to disengage the handle cams 39, 40 from within the receiver lugs 41, 42. Before such rotation is effected, however, the pump assembly may be drained of any trapped fluid by removing the drain plug 47 at the outer end of the pump assembly in the manner previously described.

From the foregoing, it will now be apparent that the pump assembly of the present invention provides a simple and effective way, through mechanical leverage, both to push the pump assembly into the receiver and pull the pump assembly out depending on the direction of handle rotation. Also, the cams on the handle assembly retain the pump assembly within the receiver housing in the locked position which corresponds to the operating position of the pump assembly, and prevent the pump assembly from falling out or being pulled out of the receiver when the handle assembly is in the unlocked position and the pump assembly is in the pump drain position. Moreover, the pump axis is desirably inclined from the vertical to improve pump inlet fuel flow conditions and minimize pump height.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

What is claimed is:

1. In combination, a pump assembly and a receiver therefor, said pump assembly comprising a pump housing having an inner end and an outer end, pivotal handle means mounted on said outer end, and cam means on said handle means for pivotal movement therewith, and said receiver having a bore for receipt of said pump assembly, and lug means engageable by said cam means, said pump assembly being rotatable in opposite directions upon insertion of said pump assembly to a non-operating position extending part way into said receiver for receipt of said cam means within slot means in said lug means and removal therefrom, and said handle means being pivotal between closed and open positions when said cam means is received within said slot means in said lug means to cause a camming action of said cam means against said lug means to respectively push said pump assembly further into said receiver to an operating position and pull said pump assembly back out to said non-operating position.

2. The combination of claim 1 further comprising seal means between said pump assembly and receiver which are respectively engaged and disengaged during camming movement of said pump assembly between said operating and non-operating positions.

3. The combination of claim 2 wherein said pump housing and receiver bore are stepped to facilitate engagement and disengagement of said seal means during camming movement of said pump assembly between said operating and non-operating positions.

4. The combination of claim 3 wherein there are a plurality of said seal means which are respectively engaged and disengaged during camming movement of said pump assembly between said operating and non-operating positions.

5. The combination of claim 1 wherein said receiver has a coaxial fluid inlet at the inner end of said receiver, and shut-off valve means which is biased into closing engagement with said fluid inlet, and said pump assembly has means on the inner end of said pump housing which is forced into and out of engagement with said shut-off valve means during camming movement of said pump assembly between said operating and non-operating positions to respectively open and close said shut-off valve means.

6. The combination of claim 5 wherein said cam means is in an over center position when said handle means is in said closed position, whereby any forces acting on said pump assembly tending to push said pump assembly out of said operating position will urge said handle means toward said closed position.

7. The combination of claim 6 wherein said shut-off valve means is supported within a valve housing at one end of said receiver by a spring arm which biases said valve means toward said fluid inlet, said spring arm being operative to create a reaction force which is exerted coaxially on the inner end of said pump assembly to compensate for any tolerances in said receiver and pump assembly when said pump assembly is in the operating position and said shut-off valve means is open.

8. The combination of claim 5 wherein said receiver includes vapor vent valve means intermediate the length thereof, and said pump assembly has a ramp surface which is forced into and out of engagement with said vapor vent valve means during camming movement of said pump assembly between said operating and non-operating positions to respectively open and close said vapor vent valve means.

9. The combination of claim 8 wherein said pump assembly has a pump inlet which communicates with said receiver inlet when said shut-off valve means is open, and a pump outlet, and vent passages communicating with said vapor vent valve means, and seal means which are engaged upon movement of said pump assembly to said operating position to isolate said pump inlet and outlet and vent passages within said receiver.

10. The combination of claim 1 further comprising orientation means on said pump housing and receiver which permit said pump assembly to be initially inserted part way into said receiver in only one rotational orientation.

11. The combination of claim 10 further comprising stop means for limiting the initial inward movement of said pump assembly into said receiver to a position in which said cam means on said handle means is in radial alignment with said lug means on said receiver, whereupon said pump assembly may be rotated in opposite directions to cause said cam means to respectively engage and disengage said lug means.

12. The combination of claim 11 wherein said orientation means comprises orientation lugs on one of said pump housing and receiver which are adapted to be received in orientation slots on the other of said pump housing and receiver.

13. The combination of claim 12 wherein said stop means comprises a stop shoulder within said orientation slots which is adapted to be engaged by said orientation lugs when said cam means on said handle means are in radial alignment with said lug means in said receiver.

14. The combination of claim 1 wherein said receiver in internally mounted within a fluid storage tank, said receiver having a fluid inlet opening at the innermost end thereof open to the interior of said tank, and an access opening at the outermost end thereof accessible from the exterior of said tank for insertion of said pump assembly into said receiver and removal therefrom.

15. The combination of claim 1 wherein said handle means comprises an outer handle portion having arms at opposite ends thereof, said arms having inner ends pivotally connected to said pump assembly on opposite sides of said pump assembly, and said cam means comprises cams on the inner ends of said arms which are pivotally connected to opposite sides of said pump assembly, and said lug means comprises a pair of lugs on opposite sides of said receiver for receipt of said cams.

16. The combination of claim 15 wherein said cams are in an over center position when said pump assembly is in the operating position and said handle means is in the closed position, whereby any forces acting on said pump assembly tending to push said pump assembly out of said receiver will urge said handle means toward said closed position.

17. The combination of claim 1 wherein said receiver is internally mounted within a fluid storage tank, said receiver having a fluid inlet opening at the innermost end thereof open to the interior of said tank, and an access opening at the outermost end thereof accessible from the exterior of said tank for insertion of said pump assembly into said receiver and removal therefrom, said receiver and said pump assembly contained therein being inclined at an angle relative to the vertical to improve pump inlet fluid flow conditions and minimize the height of said pump assembly within said tank.

18. A pump assembly comprising a pump housing having an inner end and an outer end, a pivotal handle assembly pivotally connected to said outer end, and cam means on said handle assembly for pivotal movement therewith, said handle means comprising an outer handle portion having arms at opposite ends thereof, said arms having inner ends pivotally connected to said outer end of said pump assembly on opposite sides thereof, and said cam means comprising cams on the inner ends of said arms, said handle means being pivotal between a first position in which said handle means extends outwardly away from said pump assembly and a second position in which said handle means is closely adjacent said outer end of said pump assembly, and electrical connector means adapted to be connected to the outer end of said pump assembly to provide power to operate said pump assembly, said electrical connector means including means for trapping said handle means in said second position.

19. The pump assembly of claim 18 wherein said means for trapping comprises a locking tab on said handle means which is overlapped by said electrical connector means when said handle means is in said second position and said electrical connector means is connected to the outer end of said pump assembly.

20. In combination, a pump assembly and a receiver therefor, said pump assembly comprising a pump housing having an inner end and an outer end, pivotal handle means mounted on said outer end, and cam means on said handle means for pivotal movement therewith, and said receiver having a bore for receipt of said pump assembly, and lug means engageable by rotation of said cam means, and said handle means being pivotal between closed and open positions when said cam means is engaged with said lug means to cause a camming action of said cam means against said lug means to respectively push said pump assembly into said receiver to an operating position and pull said pump assembly back out to a non-operating position, said receiver being internally mounted within a fluid storage tank, said receiver having a fluid inlet opening at the innermost end thereof open to the interior of said tank, and an access opening at the outermost end thereof accessible from the exterior of said tank for insertion of said pump assembly into said receiver and removal therefrom, and a cover plate for said access opening, said handle means permitting attachment of said cover plate to said tank when said pump assembly is in the operating position and said handle means is in the closed position, and said handle means interfering with such attachment when said handle means is in the open position.

21. In combination, a pump assembly and a receiver therefor, said pump assembly comprising a pump housing having an inner end and an outer end, pivotal handle means mounted on said outer end, and cam means on said handle means for pivotal movement therewith, and said receiver having a bore for receipt of said pump assembly, and lug means engageable by rotation of said cam means, and said handle means being pivotal between closed and open positions when said cam means is engaged with said lug means to cause a camming action of said cam means against said lug means to respectively push said pump assembly into said receiver to an operating position and pull said pump assembly back out to a non-operating position, said receiver being internally mounted within a fluid storage tank, said receiver having a fluid inlet opening at the innermost end thereof open to the interior of said tank, and an access opening at the outermost end thereof accessible from the exterior of said tank for insertion of said pump assembly into said receiver and removal therefrom, and electrical connector means adapted to be connected to the outer end of said pump assembly to provide power to operate said pump assembly, said electrical connector means including means for trapping said handle means in the closed position.

22. The combination of claim 21 wherein said means for trapping comprises a locking tab on said handle means which is overlapped by said electrical connector means when said handle means is in the closed position and said electrical connector means is connected to the outer end of said pump assembly.

23. The combination of claim 22 further comprising a cover plate for said access opening, said handle means permitting attachment of said access plate to said tank when said pump assembly is in the operating position and said handle means is in the closed position, and said handle means interfering with such attachment when said handle means is in the open position, and said electrical connector means is supported by electrical wire means which permit said electrical connector means to hang down through said access opening to interfere with the attachment of said cover plate to said tank when said electrical connector means is detached from said pump assembly.

24. In combination, a pump assembly and a receiver therefor, said pump assembly comprising a pump housing having an inner end and an outer end, pivotal handle means mounted on said outer end, and cam means on said handle means for pivotal movement therewith, and said receiver having a bore for receipt of said pump assembly, and lug means engageable by said cam means, said pump assembly being rotatable in opposite directions upon insertion of said pump assembly to a non-operating position extending part way into said receiver to engage and disengage said cam means from said lug means, and said handle means being pivotal between closed and open positions when said cam means is engaged with said lug means to cause a camming action of said cam means against said lug means to respectively push said pump assembly further into said receiver to an operating position and pull said pump assembly back out to said non-operating position, and a plurality of seal means between said pump assembly and receiver which are respectively engaged and disengaged during camming movement of said pump assembly between said operating and non-operating positions, said pump housing and receiver bore being stepped to facilitate engagement and disengagement of said seal means during camming movement of said pump assembly between said operating and non-operating positions, and an additional single seal means providing sealing engagement between said pump assembly and receiver when said pump assembly is in said non-operating position.

25. In combination, a pump assembly and a receiver therefor, said pump assembly comprising a pump housing having an inner end and an outer end, pivotal handle means mounted on said outer end, and cam means on said handle means for pivotal movement therewith, and said receiver having a bore for receipt of said pump assembly, and lug means engageable by said cam means, said pump assembly being rotatable in opposite directions upon insertion of said pump assembly to a non-operating position extending part way into said receiver to engage an disengage said cam means from said lug means, and said handle means being pivotal between closed and open positions when said cam means is engaged with said lug means to cause a camming action of said cam means against said lug means to respectively push said pump assembly further into said receiver to an operating position and pull said pump assembly back out to said non-operating position, said receiver being internally mounted within a fluid storage tank, said receiver having a fluid inlet opening at the innermost end thereof open to the interior of said tank, and an access opening at the outermost end thereof accessible from the exterior of said tank for insertion of said pump assembly into said receiver and removal therefrom, said receiver and said pump assembly contained therein being inclined at an angle relative to the vertical to improve pump inlet fluid flow conditions and minimize the height of said pump assembly within said tank.

26. In combination, a pump assembly and a receiver therefor, said pump assembly comprising a pump housing having an inner end and an outer end, pivotal handle means mounted on said outer end, and cam means on said handle means for pivotal movement therewith, and said receiver having a bore for receipt of said pump assembly, and lug means engageable by said cam means, said pump assembly being rotatable in opposite directions upon insertion of said pump assembly to a non-operating position extending part way into said receiver to engage and disengage said cam means from said lug means, and said handle means being pivotal between closed and open position when said cam means is engaged with said lug means to cause a camming action of said cam means against said lug mean to respectively push said pump assembly further into said receiver to an operating position and pull said pump assembly back out to said non-operating position, said receiver being internally mounted within a fluid storage tank, said receiver having a fluid inlet opening at the innermost end thereof open to the interior of said tank, and an access opening at the outermost end thereof accessible from the exterior of said tank for insertion of said pump assembly into said receiver and removal therefrom, and a cover plate for said access opening, said handle means permitting attachment of said access plate to said tank when said pump assembly is in the operating position and said handle means is in the closed position, and said handle means interfering with such attachment when said handle means is in the open position.

27. In combination, a pump assembly and a receiver therefor, said pump assembly comprising a pump housing having an inner end and an outer end, pivotal handle means mounted on said outer end, and cam means on said handle means for pivotal movement therewith, and said receiver having a bore for receipt of said pump assembly, and lug means engageable by said cam means, said pump assembly being rotatable in opposite directions upon insertion of said pump assembly to a non-operating position extending part way into said receiver to engage and disengage said cam means from said lug means, and said handle means being pivotal between closed and open positions when said cam means is engaged with said lug means to cause a camming action of said cam means against said lug means to respectively push said pump assembly further into said receiver to an operating position and pull said pump assembly back out to said non-operating position, said receiver being internally mounted within a fluid storage tank, said receiver having a fluid inlet opening at the innermost end thereof open to the interior of said tank, and an access opening at the outermost end thereof accessible from the exterior of said tank for insertion of said pump assembly into said receiver and removal therefrom, and electrical connector means adapted to be connected to the outer end of said pump assembly to provide power to operate said pump assembly, said electrical connector means including means for trapping said handle means in the closed position.

28. The combination of claim 27 wherein said means for trapping comprises a locking tab on said handle means which is overlapped by said electrical connector means when said handle means is in the closed position and said electrical connector means is connected to the outer end of said pump assembly.

29. The combination of claim 28 further comprising a cover plate for said access opening, said handle means permitting attachment of said cover plate to said tank when said pump assembly is in the operating position and said handle means is in the closed position, and said handle means interfering with such attachment when said handle means is in the open position, and said electrical connector means is supported by electrical wire means which permit said electrical connector means to hang down through said access opening to interfere with the attachment of said cover plate to said tank when said electrical connector means is detached from said pump assembly.

* * * * *